US005275140A

United States Patent [19]

Knoedl et al.

[11] Patent Number: 5,275,140

[45] Date of Patent: Jan. 4, 1994

[54] SPEED GOVERNOR FOR FUEL INJECTION PUMPS OF INTERNAL COMBUSTION ENGINES

[75] Inventors: Helmut Knoedl, Ludwigsburg; Karsten Hummel, Beilstein-Schmidhausen; Sieghart Maier, Gerlinge; Rolf Mueller, Stuttgart, all of Fed. Rep. of Germany

[73] Assignee: Robert Bosch GmbH, Stuttgart, Fed. Rep. of Germany

[21] Appl. No.: 10,701

[22] Filed: Jan. 29, 1993

[30] Foreign Application Priority Data

Jan. 31, 1992 [DE] Fed. Rep. of Germany ..... 4202732

[51] Int. Cl.[5] ..... F02D 31/00

[52] U.S. Cl. ..... 123/364; 74/574; 123/373

[58] Field of Search ..... 123/364, 373, 365, 370; 73/526; 74/572–

[56] References Cited

U.S. PATENT DOCUMENTS

| | | | |
|---|---|---|---|
| 3,269,193 | 8/1966 | Kleeberger | 73/526 |
| 3,699,816 | 10/1972 | Peltret | 73/526 |
| 3,841,111 | 10/1974 | Staudt et al. | 73/526 |
| 4,362,139 | 12/1982 | Isobe et al. | 123/364 |
| 4,380,442 | 4/1983 | Amsel | 74/574 |
| 4,426,970 | 1/1984 | Galis et al. | 123/364 |
| 4,463,720 | 8/1984 | Ritter | 123/364 |
| 4,735,180 | 4/1988 | Kramer | 123/364 |
| 4,944,279 | 7/1990 | Woodard | 74/574 |
| 5,050,446 | 9/1991 | Takashima et al. | 74/572 |
| 5,188,002 | 2/1993 | Wolf et al. | 74/572 |

FOREIGN PATENT DOCUMENTS

| | | | |
|---|---|---|---|
| 521173 | 5/1940 | United Kingdom | 73/526 |

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

A speed governor for fuel injection pumps of internal combustion engines in which part of an oscillation damper member, in the form of a capsule, is disposed between a drive shaft and a flyweight adjuster; two claws of a support that receives the flyweights of the centrifugal adjuster and two claws of a coupling element connected to the drive shaft. The two claws are connected to one another by way of a segmented type buffer element, all of which protrude into the capsule. The claws of the coupling element protrude into the open part of the capsule, while the claws of the support protrude into the capsule through openings in the capsule bottom. For the sake of greater strength of the capsule, the openings are embodied in closed form according to the invention.

4 Claims, 2 Drawing Sheets

SPEED GOVERNOR FOR FUEL INJECTION PUMPS OF INTERNAL COMBUSTION ENGINES

BACKGROUND OF THE INVENTION

The invention is based on a speed governor for fuel injection pumps of internal combustion engines as defined hereinafter. A speed governor of this type, known from *Diesel-Einspritzausrustung, Drehzahlregler fur Reiheneinspritzpumpen* [Diesel-fuel Injection Equipment, Speed Governor For In-line Fuel Injection Pumps], Bosch Technical Instruction 1 987 722 013, KH/VDT - 09.75-De, page 25, has a centrifugal adjuster, which is connected to the camshaft of the fuel injection pump and is driven in rotation by it, and which, via a lever mechanism by way of the outward motion of its flyweights, adjusts a governor lever that is connected to the governor rod of the fuel injection pump, and thus controls the required fuel injection quantity as a function of the rpm. To that end, the camshaft of the fuel injection pump is coupled to a flyweight-carrying support. To prevent further transmission of the camshaft oscillation and vibrations of the centrifugal adjuster and thus to prevent related control imprecision, an oscillation damper member is disposed in the coupling between the support and the camshaft in the known speed governor. This damper member has a cup-shaped capsule, into whose interior two diametrically opposed claws of the support and two diametrically opposed claws of a coupling element, which is securely connected to the camshaft, protrude, and one buffer element, preferably made of rubber for the sake of damping, is disposed between the claws, which are offset from each other by 90 degrees. While the claws of the coupling element protrude into the open part of the cup-shaped capsule, the claws of the support resting on the other side of the capsule have recesses in the shape of grooves, in the bottom of the capsule, which are open to the inner bore of the capsule leading to the coupling element. The transmission of the rotary motion is thus effected from the claws of the coupling element, via the buffers, to the claws of the support. The vibration and oscillation of the pump camshaft and the relative rotation of the claws with respect to each other thus produce pulsating compressive stresses on the buffer element, which are transmitted to the damper capsule. The pulsating motion of the elastic buffer elements is therefore borne by the damper capsule, and as a result, because of the notch effect through the radii in the groove base, causes permanent breaks on the capsule wall.

OBJECT AND SUMMARY OF THE INVENTION

According to the invention, the speed governor has an advantage over the prior art that, because of the structure of the recesses in the capsule bottom, the high stress peaks can be dissipated at the transitions between the axial ring element and the radial ring element of the capsule. In this manner in contrast to open grooves known in the state of the art, the force induction is not restricted to the vicinity of the transition between the capsule bottom and the capsule wall; because of the groove closed off by the crossbar, force induction also takes place into the closed, reinforced capsule bottom, which can now help the radial ring absorb forces. Reinforcing the capsule in this way not only preserves the same dimensions but has the additional advantage that a non-cost-effective reinforcement of the material of the radial ring of the capsule may be dispensed with.

Additional advantageous embodiments of the capsule may be found herein, in which an increased strength of the ring is achieved by reinforcing the material of the capsule wall. In order not to have to provide the expensive material reinforcement of the entire capsule wall, the aforementioned ends are then upset or drawn, to form a collar. Even measures entailing these minimal efforts bring about an increased strength of the radial ring of the capsule, thereby minimizing the danger of damage from breakage of the capsule of the damper member from the pulsating compressive stress.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
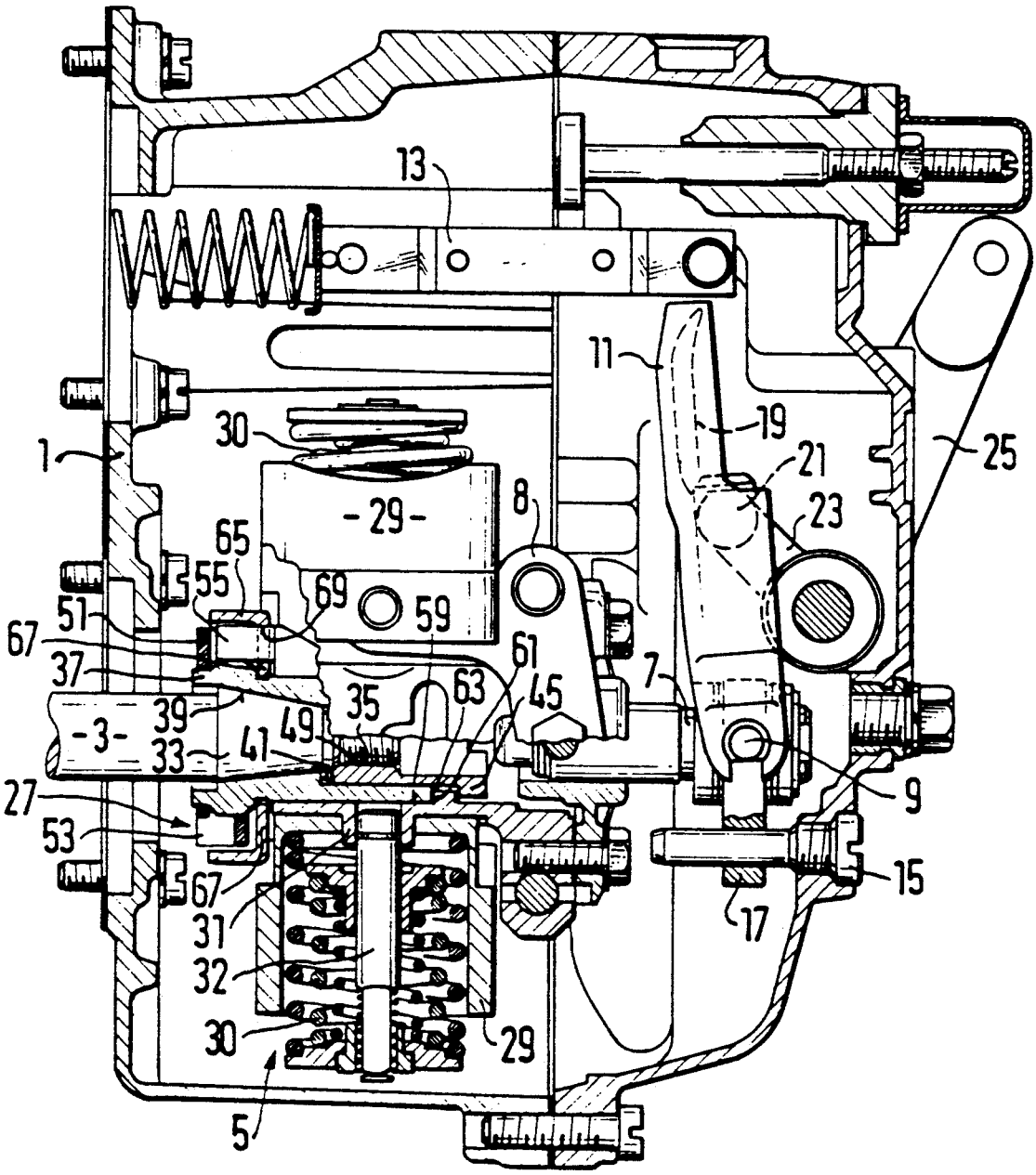
FIG. 1 shows a longitudinal section through the speed governor of the invention.

The description of the speed governor shown in FIG. 1 is essentially limited to the illustration of pertinent parts of the invention. In this case, a drive shaft 3 protruding from the housing 1 of the speed governor, which may be the camshaft of a fuel injection pump (not shown) adjacent to the speed governor, drives a centrifugal adjuster 5 which is secured to the camshaft and whose governor sleeve 7, serving as an adjustment member, is connected by way of four bell cranks 8 to two flyweights 29 of the centrifugal adjuster 5; via a bolt 9, it engages a pivotable governor lever 11 whose other end is rotatably connected to a governor rod 13 of the fuel injection pump, not shown. The bolt 9 connecting the governor lever 11 and governor sleeve 7 is in turn supported in a sliding block 17 that is displaceably disposed on a guide bolt 15. A slot guide 19 is located in the governor lever 11, and a movable block 21 is located in the slot guide; the sliding block 17 is engaged by a steering lever 23 connected to an adjustment lever 25, via a bearing secured to the housing; the lever 25 transmits a variation in the governor rod position as desired by the driver.

To transmit the rotary motion of the drive shaft 3 to the centrifugal adjuster 5 while at the same time preventing the transmission of oscillation to the centrifugal adjuster 5, the drive shaft 3 is connected, via an interposed oscillation damper member 27, to a support 31 that receives two pins 32 for receiving two flyweights 29 and also receives one governor spring 30 of the centrifugal adjuster 5 at a time, the governor spring counteracting the outward motion of the flyweights 29.

Figure 2:
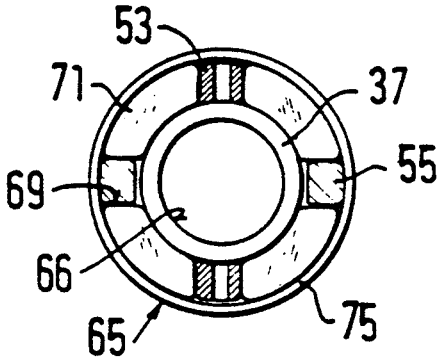
FIG. 2 is a cross section of FIG. 1, showing the connection of the drive shaft and the centrifugal governor.

For that purpose in the end of the drive shaft protruding into the housing 1 of the speed governor, the drive shaft 3 has a cone shaped diameter reduction 33, which merges with an end piece of constant diameter on which a thread 35 is arranged. The end of the drive shaft 3 protruding into the housing 1 sits in a coupling element 37 in the shape of a sheath which also has in its interior a diameter reduction 39, corresponding to the conical diameter reduction 33 of the drive shaft 3. At its narrowest diameter, this cone-shaped diameter reduction 39 abruptly changes into a wider diameter, thus forming a shoulder 41 within the coupling element 37. An intermediate sheath 45 is located in the installation on the shoulder 41 in the vicinity of the interior wall of the coupling element 37, resting on this shoulder 41. In its interior wall surface, this intermediate sheath 45 has a thread 49, into which the thread 35 of the drive shaft 3 is screwed, so that the drive shaft 3 is axially braced against the cone 39 in the coupling element 37, thereby creating a forceful connection between drive shaft 3 an coupling element 37. On its end remote from the drive shaft 3, the coupling element 37, on its outer circumference, has a diameter increase, which via a shoulder merges with a disk 51 defining the coupling element 37. This disk 51, on the side facing the end of the drive shaft 3, has two diametrically opposed claws 53 which with the interposition of the oscillating damper member 27 cooperate with two claws 55 of the support 31, as shown in FIG. 2. These claws 55 are likewise arranged diametrically opposite one another on the cylindrical outer circumference of the support 31, each offset by 90 degrees from the threaded pins 32 that receive the flyweights 29 of the centrifugal adjuster 5. In its interior, the support 31 has a central bore 59, in which the coupling element 37 is guided over its outer circumference; a shoulder 61 defines the bore 59 on the side facing away from the coupling element 37 forms a stop at which the face end 63 remote from the disk 51 of the coupling element 37 comes to rest. (FIG. 1.) Between the support 31 and the coupling element 3 guided therein is a cup-shaped capsule 65 which is a part of the oscillation damper member 27; it has a cylindrical capsule wall 75 and an annular capsule bottom 67 integrally joined to the wall 75, arranged in such a manner that it is guided by way of a central bore 66 in the capsule bottom 67 on the outer circumference of the coupling element 37; the claws 53 of the coupling element 37 protrude into the open part of the capsule 65, and the claws 55 of the coupling element also protrude into the open part of the capsule 65, but by way of openings 69 in the capsule bottom 67. The shape of these openings 69 that receive the claws 55 thereby serves a special purpose, which is further discussed in the explanation of FIG. 3.

In FIG. 2 this connection, forming the vibration damping member, between the coupling element 37 and the support 31 is shown in a section through FIG. 1. Buffer elements 71, in the form of annular segments and preferably made of rubber, which fix the location of the claws 55 and 53 relative to one another and thus create a force-transmitting connection between the coupling element 37, which is firmly braced against the drive shaft 3, and the support 31, are disposed in the capsule interior, between the claws 55 and 53, which are offset from each other by 90 degrees.

Figure 3:
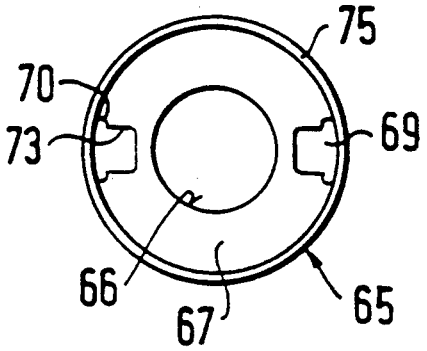
FIG. 3 shows the embodiment according to the invention of the oscillation damper capsule.

The capsule 65 shown in FIG. 3 illustrates the characteristic shape according to the invention of the openings 69 that receive the claws 55. They are substantially rectangular and are adapted to the shape of the claws 55. The openings 69 are bounded radially outward by the capsule wall, and radially inward by a land of the capsule bottom. The transition between the lateral boundary 73 of the openings 69 in the vicinity of the capsule bottom adjoining the capsule wall, and the radially outer boundary is made in the form of partial circles, which form recesses 70 int he otherwise rectilinear lateral boundary. The form of the openings 69 in the direction of the capsule center have approximately rectangular corners. The lands reinforce the capsule bottom 67, so that the force induction during operation of the speed governor can take place not only along the capsule wall 75, but also along the capsule bottom. The circular recesses 70 on the radially outward boundaries of the openings 69 minimize a notch effect occurring there.

Figure 4:
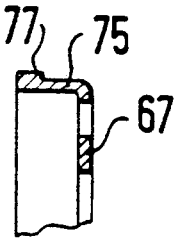
FIG. 4–6 show various variant embodiments of the radial ring of the oscillation damper capsule.
Figure 5:
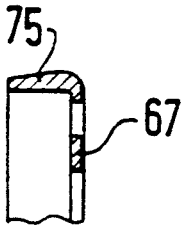
Figure 6:
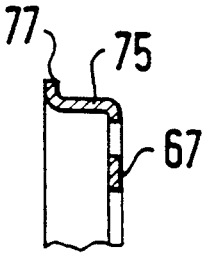

FIGS. 4–6 show additional options for reinforcing the capsule 65. In this case the capsule wall 75 in FIG. 4 is upset, with a collar 77; in FIG. 5 it is conically upset; and in FIG. 6 it is drawn, forming a collar 77. As compared to the unreinforced capsule wall 75, these wall reinforcing measures off substantial advantages in terms of durability of the capsule 65 of the oscillation damper element 27.

The speed governor according to the invention functions as follows: During the operation of the fuel injection pump of the internal combustion engine to be supplied, the drive shaft 3 is set by the pump into a rotary motion that is proportional to the engine rpm. This motion is transmitted 31 by way of the coupling element 37 and its claws 53, via the buffer elements 71 inside the capsule 65, to the claws 55 of the support 31. The rotary motion of the support 31, which carries the flyweights 29 and makes up part of the centrifugal adjuster 5, pushes the flyweights 29 outward counter to the force of the governor springs 30, and by way of the bell cranks 8, they displace the governor sleeve 7 in the direction of the drive shaft 3. If the adjusting lever 25 and steering lever 23 are stationary, the governor lever 11 is pivoted about the sliding block 21, which displaces the governor rod 13 in the direction of a lower fuel supply quantity, i.e., in the direction away from the drive shaft 3, until a balance is achieved between the engine rpm, and hence the rpm of the centrifugal adjuster 5, and the position of the governor rod 13, which determines the required fuel quantity.

If the driver wishes a change in rpm, the governor lever 11 is shifted via the adjusting lever 25 and the steering lever 23; in this changed position of the governor lever 11, the above-described adjustment of the balance between the governor rod position and rpm is repeated once more.

To prevent the oscillation occurring in the drive shaft 3 from being transmitted to the centrifugal adjuster 5, the buffer elements 71 disposed in the capsule 65 between the claws 55 and 53 damp this oscillation during force transmission. The alternating stresses on the buffer elements 71 cause them to pulsate and change their outer shape, and these forces are borne by the damper capsule 65 around the buffer elements. Because of the shape, according to the invention, of the openings 69 that receive the claws 55 of the support 31, a reinforcement of the capsule bottom 67 and thus of the entire capsule 65 is achieved, so that for the most part, damage from breakage can be prevented.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A speed governor for fuel injection pumps of internal combustion engines, having a centrifugal adjuster (5) with flyweights (29) supported on a support (31), said flyweights are adjustable counter to a governor spring (30) and whose adjusting motion is transmitted to a governor rod (13) that controls a supply quantity of the fuel injection pump, wherein the centrifugal adjuster (5) is driven by a drive shaft (3) of the fuel injection pump, which is connected to a coupling element (37) of the centrifugal adjuster (5), the coupling element having two diametrically opposed claws (53) on a side toward the support (31) of the centrifugal adjuster (5), wherein the support, on a face end toward the coupling element (37), has two diametrically opposed claws (55), between said opposed claws (55) and the claws (53) of the coupling element (37), circular-segmentally supported buffer elements (71) are disposed in a cup-shaped capsule (65), said cup-shaped capsule (65) has a cylindrical capsule wall (75) and an annular capsule bottom (67), which is integrally joined to the capsule wall and has recesses through which claws (55) and (53) of the support (31) or of the coupling element (37) can pass, the recesses are openings (69) in the capsule bottom adapted to the cross section of the respective claws (53, 55).

2. A speed governor as defined by claim 1, in which the capsule wall (75) has a conical upset portion on its end facing the capsule bottom (67).

3. A speed governor as defined by claim 1, in which the capsule wall (75) has a collar (77), angled outward, on an end remote from the capsule bottom (67).

4. A speed governor as defined by claim 1, in which the openings (69) are substantially rectangular in shape, border the capsule wall (75) on one side, and there have circular transitions at the corners.

* * * * *